US005338367A

United States Patent [19]

Henriet et al.

[11] Patent Number: 5,338,367

[45] Date of Patent: Aug. 16, 1994

[54] PICKLING PROCESS IN AN ACID BATH OF METALLIC PRODUCTS CONTAINING TITANIUM OR AT LEAST ONE CHEMICAL ELEMENT OF THE TITANIUM FAMILY

[75] Inventors: Dominique Henriet, Chambourcy; Didier Paul, Gueugnon; Laurent Prost, Ugine, all of France

[73] Assignee: Ugine, Aciers de Chatillon et Gueugnon, Puteaux, France

[21] Appl. No.: 987,259

[22] Filed: Nov. 18, 1992

Related U.S. Application Data

[63] Continuation of Ser. No. 655,433, filed as PCT/FR90/00564, Jul. 25, 1990, published as WO 91/02109, Feb. 21, 1991, abandoned.

[30] Foreign Application Priority Data

Jul. 26, 1989 [FR] France ..... 89 10093

[51] Int. Cl.[5] ..... C23G 1/02

[52] U.S. Cl. ..... 134/3; 134/41

[58] Field of Search ..... 134/3, 41

[56] References Cited

U.S. PATENT DOCUMENTS

| | | | |
|---|---|---|---|
| 2,942,954 | 6/1960 | Thomas | 134/41 |
| 3,258,429 | 6/1966 | Weed | 252/631 |
| 3,463,733 | 8/1969 | Achenbach | 134/41 |
| 4,902,472 | 2/1990 | Isobe et al. | 420/54 |

FOREIGN PATENT DOCUMENTS

| | | | |
|---|---|---|---|
| 2587369 | 3/1987 | France . | |
| 0123529 | 9/1979 | Japan | 134/3 |
| 0243289 | 12/1985 | Japan | 134/3 |
| 360126 | 11/1931 | United Kingdom . | |
| 2000196 | 1/1979 | United Kingdom . | |
| 8701739 | 3/1987 | World Int. Prop. O. . | |

OTHER PUBLICATIONS

Patent Abstracts of Japan, vol. 11, No. 322 (C-453), Oct. 20, 1987, & JP-A-62 109 998.

Chemical Abstracts, vol. 107, No. 26, Dec. 28, 1987, p. 82, Resume No. 241263w, Columbus, Ohio, US; & JP-A-62 077 489 (Nippon Mining) Sep. 4, 1987.

*Primary Examiner*—R. Bruce Breneman

*Assistant Examiner*—Zeinab El-Arini

*Attorney, Agent, or Firm*—Oblon, Spivak, McClelland, Maier & Neustadt

[57] ABSTRACT

Pickling process in an acid bath containing an oxidant in order to enhance the pickling kinetics, wherein at least one peroxygenated derivative of titanium or at least of one element of the titanium family included in the product to be pickled is formed, the metal being ionized to a higher valency, the formation of the peroxygenated compound is controlled by measurement of the redox potential, and the quantity of oxidizing agent is limited so as to maintain an oxido-reduction potential lower than the passivation potential of the metallic product.

13 Claims, No Drawings

PICKLING PROCESS IN AN ACID BATH OF METALLIC PRODUCTS CONTAINING TITANIUM OR AT LEAST ONE CHEMICAL ELEMENT OF THE TITANIUM FAMILY

This application is a continuation of application Ser. No. 07/655,433, filed as PCT/FR90/00564, Jul. 25, 1990, published as WO 91/02109, Feb. 21, 1991, now abandoned.

The present invention relates to a process for performing the pickling of metallic products containing titanium or at least one chemical element of the titanium family in an acid bath.

In the field of metallurgy it is known that, in the course of production, the metallic products or metallic alloys subjected to forging operations and thermal treatment become covered with a layer of scale. In view of the necessity to produce a good surface capacity on the finished products, the whole of the layer of scale formed must consequently be removed by a pickling operation.

According to a known process, the pickling operation consists of plunging the finished products in pickling baths composed of nitric acid $HNO_3$ and hydrofluoric acid HF in a proportion of 6 to 16% of $HNO_3$ per liter and from 1 to 5% of HF per liter, the operational temperature of the baths being included in the range from 40° C. to 60° C.

One of the most commonly used pickling baths for pickling titanium is based on nitric acid, an acid which leads to the generation of the particularly toxic $NO_2$ fumes and nitrated products in the effluents (nitrites and nitrates). Although the permitted maximal nitrate concentration is relatively high, the permitted content of nitrites is much lower because the nitrites lead to the formation of nitrosamines, which are noxious substances.

A pickling process for titanium-based metallurgical products is also known which consists in the use of a bath composed of a mixture of halogenated acids containing mainly hydrochloric acid HCl and hydrofluoric acid HF.

The disadvantage of this process is that, on dissolution, the titanium is reduced to valency III and forms volatile compounds.

For example, on dissolution in hydrochloric acid titanium is transformed into $TiCl_3$, which begins to sublime at 80° C. Before sublimation, the $TiCl_3$ decomposes into $TiCl_4+TiCl_2$ according to the equation:

$$2\ TiCl_3 \rightarrow TiCl_4 + TiCl_2 \qquad (I)$$

$TiCl_4$ is particularly volatile, its vapour pressure at 50° C. being equal to 42 mm of Hg.

The object of the invention is a pickling process in an acidic medium for metallic products containing titanium or at least one chemical element of the titanium family, a process by which an oxidant is introduced into the acid bath, which avoids the disadvantages of the pickling processes described above, wherein, in order to enhance the kinetics of pickling, at least one peroxygenated derivative of titanium or at least one element of the titanium family included in the product to be pickled is formed, the metal being ionized to a higher valency, the formation of the peroxygenated compound is controlled by measurement of the redox potential, and the quantity of oxidizing agent is limited so as to maintain an oxido-reduction potential lower than the passivation potential of the metallic product.

Such a process is based on the fact that when the oxygenated derivatives of the metal are ionized to a higher valency they become aggressive towards the metal itself and to its oxides ionized to a lower valency. By ionization to a higher valency are meant, in particular, the ions such as titanate, vanadate, zirconate, niobate, tantalate and uranate.

The acid pickling bath is preferably a bath containing essentially an acid selected from hydrofluoric acid, sulfuric acid, hydrochloric acid, phosphoric acid and formic acid, but another acid could be used which is capable of pickling the oxidized titanium or a mixture of mineral acids such as $HF—H_2SO_4$.

In order to initiate pickling kinetics, a powerful oxidizing agent, which leads to the formation of at least one peroxygenated derivative of the metal, is introduced into the acid bath.

It should be noted that titanium and the elements of the titanium family form oxygenated derivatives with oxidants. Depending on the degree of oxidation attained, compounds of the following type are obtained:

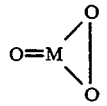

M being Ti or one of the chemical elements of the Ti family. Such compounds constitute per-salts, particularly powerful oxidizing substances.

The oxidizing agent is preferably selected from hydrogen peroxide, urea peroxide or a gas such as ozone or oxygen.

Hydrogen peroxide is introduced directly into the acid bath in an amount less than 0.5% by weight; it may also be introduced in the form of a per-salt or a per-acid, a substance which gives rise to hydrogen peroxide by decomposition in an acidic medium. Urea peroxide may be used in an amount less than 1.2% by weight.

The following description will make it easier to understand the invention.

The process according to the invention relates to a pickling process in an acid bath of metallic products or metallic alloys containing titanium or at least one chemical element of the titanium family, in particular vanadium, zirconium, niobium, tantalum and uranium.

The mechanism of the pickling reaction is similar for the different metals mentioned and for the alloys.

As an illustration, we will describe in detail the pickling process for titanium.

The standard acid bath is preferably a bath of hydrofluoric acid, the concentration of which is included in the range 0.2–10% by weight. Other acids may be used such as, for example, sulfuric acid, provided that they contain a peroxygenated form of the metallic element of the titanium family included in the product to be pickled.

In the case of the pickling of titanium, laboratory tests have shown that the oxidized titanium is attacked by hydrofluoric acid according to the reaction:

$$2Ti + 6HF \rightarrow 2TiF_3 + 3H_2 \qquad (II)$$

Titanium trifluoride is converted into the tetrafluoride $TiF_4$ in the presence of an excess of HF.

In order to speed up the pickling kinetics, the process according to the invention consists of forming at least one oxygenated derivative of the metal ionized to its higher valency and, in the case of the pickling of titanium, a peroxygenated derivative of titanium, the pertitanate, which is particularly aggressive towards titanium and its oxides.

The formation of the pertitanate is achieved, for example, by the action of hydrogen peroxide on titanium fluoride, according to the following reactions:

$$Ti^{4+}+H_2O_2+2H_2O \rightarrow TiO_4^{2-}+6H^+ \quad \text{(III)}$$

$$2TiO_4^{2-}+Ti+16H^+ \rightarrow 3Ti^{4+}+8H_2O \quad \text{(IV)}$$

In the reaction (IV), there is no longer an excess of $H^+$ but instead the formation of $H_2O$, which reduces the effect of the introduction of $H^+$ into the meshes of the crystalline network of the metal or alloy to be pickled and thus reduces the brittleness of the pickled product.

The pertitanate may also be obtained by the action of urea peroxide which, by decomposition, gives rise to hydrogen peroxide. This compound is a solid and hence can be transported more easily.

Alternatively, the formation of the pertitanate may be achieved by injecting ozone into the bath. The reactions leading to the formation of the pertitanate are then:

$$Ti^{4+}+O_3+H_2O \rightarrow Ti_4^{2-}+H_2^+ \quad \text{(V)}$$

$$2TiO_4^{2-}+Ti+16H^+ \rightarrow 3Ti^{4+}+8H_2O \quad \text{(VI)}$$

The ozone can be replaced by oxygen.

It is known that the introduction of a per-salt into an acidic medium gives hydrogen peroxide by decomposition. The per-salts which can be used are, in particular, permanganates, persulfates, pertitanates, pervanadates, perborates . . . .

The per-acids which also decompose into $H_2O_2$ in acidic medium can also be used. Mention may be made in particular of: perboric acid, pertitanic acid, peracetic acid, persulfuric acid which are, for the most part acids used in other industrial fields.

The formation of the $TiO_4^{2-}$ is controlled by measuring the oxidation-reduction potential of the pickling bath. The REDOX potential is the potential difference measured between a corrosion-resistant electrode (for example, platinum) and a reference electrode (for example, Ag/AgCl or saturated calomel), both of these electrodes being immersed in the bath to be studied. The measured value makes it possible to characterize the oxidizing power of the pickling bath, on the one hand, and to adjust the bath by the introduction of chemical compounds in order to maintain a defined oxidizing capacity of the bath, on the other. For the pickling of titanium or a compound of titanium, the oxido-reduction potential is included in particular in the range:

$$(+150, -350)\ mV/Ag/AgCl.$$

The process according to the invention improves the efficiency of pickling of titanium and its alloys, chemical elements of the titanium family and their alloys and does so by making use of a standard bath preferably containing only a single acid, an oxidizing bath the principal oxidizing agent of which is a peroxygenated compound of titanium or an element of the titanium family.

In an example of the pickling of titanium by means of the process according to the invention, the loss of weight of flat products is from 40 to 80 $g/m^2$. The state of the surface obtained is comparable to that obtained with the aid of the nitro-hydrofluoric process. No overpickling effects are produced. The use of hydrogen peroxide gives a treated, whitened surface with an aesthetically pleasing appearance.

The value of the process according to the invention resides in particular in the fact that the oxidant is generated "in situ" without addition of toxic or polluting substances.

Since the pickling reaction is carried out principally by the pertitanate and/or peroxide of the elements of the titanium family, the consumption of hydrofluoric acid is reduced.

This process does not cause atmospheric pollution; furthermore, the effluents can be treated and recycled, and this prolongs the useful life of the pickling baths.

The formation of peroxygenated compounds (pertitanates, perzirconates, pertantalates, perniobates, peruranates, pervanadates) requires the addition of $H_2O_2$, a substance of particular interest from the ecological point of view because it decomposes into $H_2O$ and $O_2$, a feature favourable to biogenesis.

The process according to the invention thus leads to the diminution, and even abolition, of toxic substances in the atmosphere and in the effluents.

As far as the effluents and the used baths are concerned, the treatment conforms to ministerial directives in industrialized countries. For example, a treatment with milk of lime leads to a precipitation of the metallic hydroxides without discharge of toxic anionic forms, which is not the case for nitrates, all of which are soluble in water. The process according to the invention is a clean and ecological process.

The use of an oxidizing bath without excess hydrogen avoids the diffusion of hydrogen into the meshes of the metallic network of the pickled piece, as happens in a reducing bath. In this way, the brittleness of the pickled products is reduced.

We claim:

1. A process for pickling a metal product of a metal selected from the group consisting of titanium, vanadium, zirconium, niobium, tantalum, uranium, or an alloy thereof in an acid bath having an oxidation-reduction potential, said metal product having a passivation potential and said acid bath being selected from the group consisting of hydrofluoric acid, sulfuric acid, hydrochloric acid, phosphoric acid, formic acid and mixtures thereof, comprising:

ionizing said metal to a higher valency and forming at least one peroxygenated derivative of said metal;

measuring said oxidation-reduction potential of said acid bath; and introducing an oxidizing agent selected from the group consisting of urea peroxide, ozone, oxygen, a per-acid and a per-salt of the following formula:

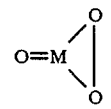

wherein M is said metal, to said acid bath in an amount which maintains said oxidation-reduction potential of said acid bath at a level lower than said passivation potential of said metal product.

2. The process according to claim 1, wherein the oxidizing agent is ozone.

3. The process according to claim 1, wherein the oxidizing agent is a per-salt.

4. The process according to claim 1, wherein the oxidizing agent is a per-acid.

5. The process according to claim 1, wherein the chemical element of the titanium family is vanadium, zirconium, niobium, or tantalum.

6. The process of claim 1, wherein said metal is titanium.

7. The process of claim 1, wherein said oxidizing agent is urea peroxide, and said urea peroxide is present in an amount less than 1.2% by weight.

8. The process of claim 1, wherein said oxidizing agent is a per-salt selected from the group consisting of a permanganate, a persulfate, a pertitanate, a pervanadate and a perborate.

9. The process of claim 1, wherein said oxidizing agent is a per-acid selected from the group consisting of perboric acid, pertitanic acid, peracetic acid and persulfuric acid.

10. A process for pickling a metal product of a metal selected from the group consisting of titanium, vanadium, zirconium, niobium, tantalum, uranium, or an alloy thereof in an acid bath having an oxidation-reduction potential, said metal product having a passivation potential and said acid bath being selected from the group consisting of hydrofluoric acid, sulfuric acid, hydrochloric acid, phosphoric acid, formic acid and mixtures thereof, comprising:

introducing hydrogen peroxide to said acid bath in an amount less than 0.5% by weight to ionize said metal to a higher valency and form at least one peroxygenated derivative of said metal;

measuring said oxidation-reduction potential of said acid bath; and maintaining said oxidation-reduction potential of said acid bath at a level lower than said passivation potential of said metal product.

11. The process of claim 10, wherein said metal product is of titanium.

12. The process of claim 11, wherein said oxidation-reduction potential of said acid bath is maintained at a level in the range of (+150, −350) mV relative to an Ag/AgCl electrode.

13. The process of claim 11, wherein said titanium metal product loses a weight of from 40 to 80 $g/m^2$ in said process.

* * * * *